US005829415A

United States Patent [19]

Matsuda

[11] Patent Number: 5,829,415

[45] Date of Patent: Nov. 3, 1998

[54] FUEL INJECTOR OF ENGINE FOR MODELS AND ENGINE FOR MODELS INCORPORATED WITH THE FUEL INJECTOR

[75] Inventor: Norio Matsuda, Mobara, Japan

[73] Assignee: Futaba Denshi Kogyo K.K., Mobara, Japan

[21] Appl. No.: 844,665

[22] Filed: Apr. 21, 1997

[30] Foreign Application Priority Data

| | | | |
|---|---|---|---|
| Apr. 19, 1996 | [JP] | Japan | 8-098582 |
| Apr. 19, 1996 | [JP] | Japan | 8-098583 |
| Apr. 19, 1996 | [JP] | Japan | 8-098585 |

[51] Int. Cl.[6] ..... F02M 23/00

[52] U.S. Cl. ..... 423/531; 123/DIG. 3

[58] Field of Search ..... 123/531, 472, 123/478, 480, DIG. 3, DIG. 5, 572

[56] References Cited

U.S. PATENT DOCUMENTS

| | | | |
|---|---|---|---|
| 5,080,079 | 1/1992 | Yoshida et al. | 123/531 |
| 5,211,682 | 5/1993 | Kadowaki et al. | 123/531 |
| 5,483,944 | 1/1996 | Leighton et al. | 123/531 |
| 5,488,933 | 2/1996 | Pham | 123/531 |

*Primary Examiner*—Raymond A. Nelli

*Attorney, Agent, or Firm*—Oblon, Spivak, McClelland, Maier & Neustadt, P.C.

[57] ABSTRACT

In a fuel injector magnetic core is inserted in the solenoid coil in the box. The fuel feeding passage is provided in the magnetic core. The movable valve body which moves up to the magnetic core magnetically is provided in the box. The valve body has a flow passage which communicates to the feeding passage. The valve body is forced to be pressed by the plate spring so as to be in contact with the valve box so as to close the fuel injection orifice. The check valve is provided on the fuel feeding passage. An air pressure of about 20 to 100 kPa generated in the crank chamber of the engine is applied to fuel in the box through the diaphragm. Fuel is introduced into the fuel injector without pressurization and confined by the check valve, and the fuel is pressurized using air which is not affected very much by the force due to acceleration. Fuel is fed stably even under severe operational conditions, the engine will not stall due to insufficient or excessive feeding of fuel. The fuel injector injects fuel in the movement direction of the model plane. The fuel injector is located ahead of the pressurized fuel tank in the movement direction of the model plane. The fuel injector is provided with the over pressure control valve for releasing the fuel to the outside when the internal fuel pressure increases and the negative pressure control valve for introducing the air pressure in the fuel tank into the internal when the internal fuel pressure decreases.

14 Claims, 9 Drawing Sheets

FUEL INJECTOR OF ENGINE FOR MODELS AND ENGINE FOR MODELS INCORPORATED WITH THE FUEL INJECTOR

BACKGROUND OF THE INVENTION

This invention relates to a programmed fuel injector provided to engines for models.

DESCRIPTION OF THE RELATED ART

Conventionally, in glow engines of two-cycle or four-cycle which have been known as an engine for models, a carburetor 100 having the structure as shown in FIG. 10 has been used as the means for controlling the feeding rate of fuel to a combustion chamber of an engine.

In the housing 101 of the carburetor 100, a valve body 102 having the shape like a cylinder is provided rotatably around the axis line of the valve body 102 itself. A pipe conduit 101*a* and 101*b* extends vertically through the housing 101, and air is supplied from the upper pipe conduit 101*a* . A passage 102*a* extends through the valve body 102, and the passage is communicated to the pipe conduits 101*a* and 101*b* of the housing 101 with the opening depending on the rotation angle of the valve body 102. An operating arm 103 is connected to a portion of the valve body 102 which projects beyond the one end of the housing 101. An operating part of a servo mechanism not shown in the figure is connected to the operation arm 103, and the servo mechanism rotates the valve body 102 in the housing 101. A needle 104 is fixed to the valve body 102 with a screw, and the projection into the valve body 102 is adjustable by turning the needle 104.

A fuel control needle valve 105 is built-in at the other end of the housing 101. The needle valve 105 has a tube 106 and a needle 107 provided in the tube 106. The needle 107 is fixed to the tube 106 with a screw, and the needle 107 is moved reverseward in the tube 106 by turning a knob 108 provided at the base of the needle and the tip opening of the tube 106 can be adjusted. The tip of the needle 104 provided to the valve body 102 is facing to the opening of the tip of the tube 106 of the needle valve 105.

Fuel fed to the needle valve 105 is jetted from the clearance between the tip of the tube 106 and the needle 107 to the internal, mixed with air supplied in the valve body 102, and fed to an engine. Because the flow rate of fuel can be adjusted by turning the know of the needle valve 107, the flow rate of fuel (or air-fuel ratio) can be previously set so that the engine rotates at the maximum rotation speed. The servo mechanism rotates the valve body 102 to adjust air flow rate into the valve body 102, and controls the flow rate of fuel fed to the engine.

According to the carburetor 100, when the engine is accelerated rapidly from the low rotation condition such as idling, a lot of air is fed in the valve body, but the supply of fuel can not follow the supply of air, and the balance of air-fuel ratio is unbalanced. The rotation of the engine increases not smoothly and increases slowly, and can be stopped in the bad case. As a whole, the response is not good, the transition from the low rotation speed to high rotation speed or the high rotation speed to low rotation speed requires a long time, it is a disadvantage of the conventional engines. Further, in the case that an engine for models is mounted on a radio control model plane, fuel is fed not adequately to the carburetor due to the adverse effect of centrifugal force caused by flying motion of the model plane, the inadequate feeding of fuel causes the malfunction of the engine.

It is an object of the present invention to provide a fuel injector which is capable of feeding fuel stably for maintaining the air-fuel balance and capable of deriving the stable and high performance of the engine for models used under the severe condition as an engine for models mounted on a radio control model plane for acrobatic flying such as loop flying.

It is another object of the present invention to provide a fuel injector which is capable of controlling the fuel injection adequate and maintaining the fuel injection pressure constant regardless of fluctuation of the fed fuel pressure.

SUMMARY OF THE INVENTION

The fuel injector of an engine for models injects the fuel pressurized with a pressure equivalent to the pressure generated in the crank chamber of the engine for models into the combustion chamber of the engine for models.

The fuel injector of an engine for models is provided with a box, a feeding passage for guiding fuel into the box, a fuel injection orifice, a solenoid coil provided in the box, a magnetic core provided in the solenoid coil, a valve body provided in the box and movable in the axial direction of the solenoid coil to the magnetic core magnetically by supplying power to the solenoid coil to open the fuel injection orifice, and a forcing means for exerting a force to press the valve body in the direction so as to close the fuel injection orifice.

The fuel injector of an engine for models involves the maximum pressure generated in the crank chamber of the engine for models in a range from 20 kPa to 100 kPa.

The fuel injector of an engine for models involves the pressing force of the forcing means prescribed to be equivalent to the force exerted to the valve body by the fuel.

The fuel injector of an engine for models involves the structure in which the axial direction of the solenoid coil is disposed in parallel to the movement direction of the model on which the engine for models is mounted, and the fuel injection orifice of the solenoid coil is directed forward in the movement direction of the model.

The fuel injector of an engine for models provided with a reverse flow preventing means for preventing the fed fuel from reversing and a pressuring means for pressurizing the fed fuel with a pressure equivalent to the pressure generated in the crank chamber of the engine for models, injects pressurized fuel into the combustion chamber of the engine for models with aid of electronic control.

The fuel injector of an engine for models is provided with a check valve as the reverse flow preventing means, and a flexible member as the pressurizing means for transmitting the air pressure generated in the crank chamber of the engine for models to the fed fuel.

The fuel injector of an engine for models utilizes the pressure generated in the crank chamber of the engine for models which is pulsatory synchronously with motion of the piston.

The fuel injector of an engine for models described in the claim 9 is provided with a box, a fuel feeding passage for guiding fuel into the box, a fuel injection orifice provided to the box, a solenoid coil provided in the box, a magnetic core provided in the solenoid coil, a valve body provided in the box and movable in the axial direction of the solenoid coil to the magnetic core magnetically by supplying power to the solenoid coil to open the fuel injection orifice, and a forcing means for exerting a force to press the valve body in the direction so as to close the fuel injection orifice. a check valve for preventing the fuel guided into the box from reversing into the fuel feeding passage, an air pressure supply passage for supplying the air pressure generated in the crank chamber of the engine for models into the box, and a flexible member for applying the air pressure supplied through the air pressure supply passage to the fuel in the box.

The fuel injector of an engine for models described in the claim 10 involves the mechanism in which the fuel pressurized with a prescribed pressure is fed in the internal and the fuel is injected into the outside by moving a valve body for controlling the opening of the fuel injection orifice, wherein the fuel injector is provided with a pressure adjusting means for adjusting the fuel pressure so that the fuel pressure resumes to the prescribed value when the pressure of the fuel fed in the internal fluctuates.

The fuel injector of an engine for models is provided with an over pressure control valve as the pressure adjusting means for releasing fuel to the outside when the pressure of the fuel fed in the internal increases.

The fuel injector of an engine for models is provided with a negative pressure control valve as the pressure adjusting means for introducing the air pressure into the internal when the pressure of the fuel fed in the internal decreases in addition to the over pressure control valve.

The fuel injector of an engine for models involves a fuel injector which is provided to the engine of a moving article on which the engine and a fuel tank are mounted, and involves disposition that the injection direction of the fuel injector is directed forward in the movement direction of the moving article, and the fuel injector is located ahead of the fuel tank in the movement direction of the moving article.

The engine for models provided with the fuel injector injects the pressurized fuel with a pressure equivalent to the pressure generated in the crank chamber of the engine for models into the combustion chamber of the engine for models with aid of electronic control.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF PREFERRED EMBODIMENTS

Figure 1:
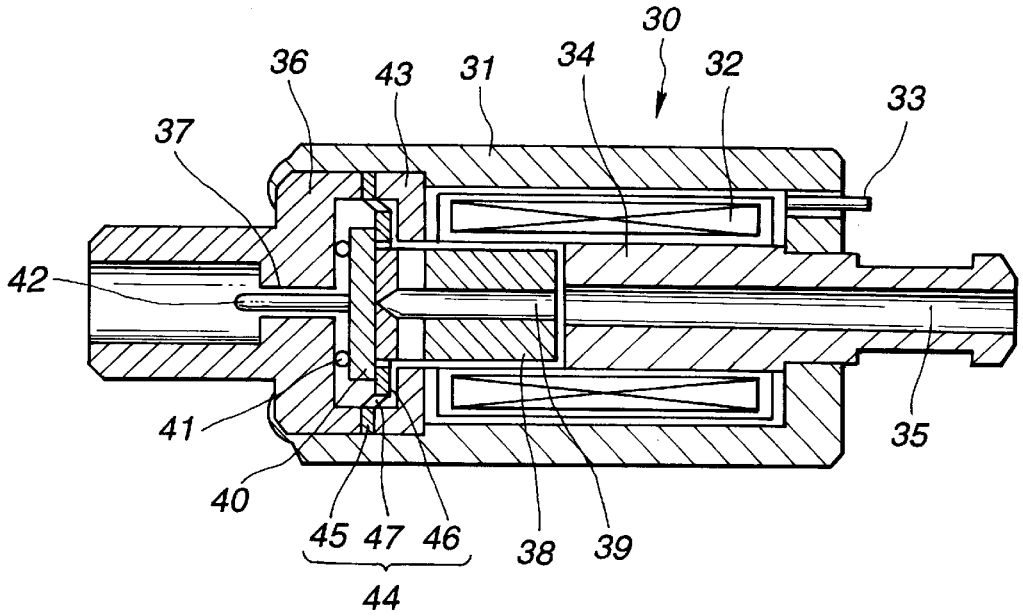
FIG. 1 is a cross-sectional view of a fuel injector of the first embodiment of the present invention.

The first embodiment of the present invention is described in detail hereinafter referring to FIG. 1 and FIG. 2. This embodiment involves an engine for models provided with a programmed fuel injector. The engine for models 1 (referred to as engine 1 hereinafter) of this embodiment is an engine to be mounted on a radio control model plane. The engine 1 shown in FIG. 1 is a four-cycle engine, provided with a cylinder S having a combustion chamber, a piston P which reciprocates in the cylinder S, and a crank shaft K which rotates synchronously with the reciprocation of the piston P. The cylinder S is provided with an air intake valve 17, exhaust valve 23, and glow plug 19 which is an ignition means. A temperature sensor is provided to the glow plug 19 to detect the temperature in the combustion chamber. Methyl alcohol fuel containing lubricating oil and ignition accelerating agent such as nitromethane is used for the engine 1. The capacity of the combustion chamber is in a range from 1 to 30 cc, and the pressure caused in the crank chamber 2 is in a range from 20 kPa to 100 kPa for the peak value of positive pressure and in a range from −20 kPa to −100 kPa for the peak value of negative pressure. The positive pressure and negative pressure are the value based on the reference of the average pressure in the crank chamber.

The engine 1 is controlled by a control means 4 of a receiver 3 mounted on the radio control model plane. When an operator operates the transmitter 5, the receiver 3 receives radio wave from the transmitter 5, and the radio wave controls every parts of the model plane including the engine 1.

The engine 1 shown in FIG. 1 is started up by a starter 6. The starter 6 is driven by power supplied from the battery 8 through a rectifier 7 and auxiliary air supplied from an air bomb 9. A selector valve 10 for selecting either the starter 6 or air bomb 9 is controlled by a control means 4 of the radio control receiver 3.

A rotation detection sensor 12 for detecting the position of the rotating crank 11 as a stroke detection means for detecting the operation cycle of the engine 1 and outputting the stroke signal is provided in the crank chamber 2. The rotation detection sensor 12 detects rotation of the engine 1 for matching the fuel injection timing, and in this embodiment, the rotation detection sensor 12 outputs the intake timing signal (the intake stroke signal as a stroke signal) as the stroke signal. The intake timing signal (intake stroke signal) outputted from the rotation detection sensor 12 is sent to the control means 4 of the radio control receiver 3, and served to control the engine 1.

An intake manifold 13 of the engine 1 is provided with a throttle valve 14 for controlling intake air, air flow rate supplied into the combustion chamber is controlled. The control means 4 of the radio control receiver 3 supplies the throttle valve adjusting signal to a throttle valve driving means 15 to control the opening of the throttle valve. An intake air and temperature sensor 16 is provided at the air intake inlet of the intake manifold 13, the signal generated from the sensor is supplied to the control means 4 of the radio control receiver 3 and used for controlling the engine 1.

The fuel injector 30 is provided near the intake valve 17 of the intake manifold 13. The fuel injector 30 and a fuel tank 26 are connected with interposition of a filter 22. The fuel flows out from the fuel tank 20 and is supplied to the fuel injector 20 through the filter 22. The fuel injector 30 injects fuel into the combustion chamber.

Pressurized fuel is supplied from the fuel tank 20 to the fuel injector 30. The internal of the fuel tank 20 and the crank chamber 2 are connected mutually with interposition of a check valve and regulator 21*a*, in this structure, the check valve 21*a* suppresses the negative pressure out of positive pressure and negative pressure caused in the crank chamber 2, and the regulator 21*a* serves to maintain the pressure constant. This structure serves so that fuel in the fuel tank is pressurized with a constant pressure.

Alternately, the structure in which pneumatic pressure from the air bomb 9 is connected to the regulator as a pressurizing means is effective also for maintaining the pressure in the fuel tank constant.

The pressure applied to fuel in the fuel tank is approximately equal to the positive pressure caused in the crank chamber 2 of the engine 1, in detail, the peak value (maximum value) is about 20 kPa to 100 kPa. Fuel flows out from the fuel tank 20 and is supplied to the fuel injector 30 through the filter 22.

Next, the structure of the above-mentioned fuel injector 30 is described. As shown in FIG. 2, the fuel injector 30 has an approximately cylindrical box 31. In the box 31, a solenoid coil 32 is contained. There is a space between the solenoid coil 32 and the inside peripheral surface of the box 31. The power source terminal 33 for feeding power to the solenoid coil 32 extends to the outside of the box 31 through the box 31 . One end of a magnetic core 34 is inserted into the solenoid coil 32 up to the middle. On the center line of the magnetic core 34, a passage 35 of fuel is formed. The other end of the magnetic core extends to the outside of the box 31 beyond the periphery of the box 31, and connected to a fuel feeding pipe conduit 18 which connects to the fuel tank 20.

At the end of the valve box 36, a fuel injection orifice 37 is formed. In the box 31, an approximately cylindrical valve body 38 is inserted movably into the solenoid coil 32 adjacent to the magnetic core 34. Another passage 39 which communicates to the passage 35 is formed in the valve body 38. At one end of the valve body 38, a flange 40 is formed. A ring contact ridge 41 for contact with the inside surface of the valve box 36 is formed on the front face of the flange near the periphery of the face. A needle 42 is fixed to the front center of the flange 40, and the needle 42 is inserted slidably into the fuel injection orifice 37 of the valve body 38.

Between the fixing member 43 of the solenoid coil 32 and the valve box 36, a forcing means for forcing the valve body 38 to press in the direction of the fuel injection orifice 37 and a plate spring 44 as a means for supporting the valve body 38 at the center position are provided. The plate spring 44 comprises a ring outside fixing part 45, ring inside moving part 46, and a connecting arm 47 for connecting both parts elastically. The fixing part is fixed between the fixing member 43 of the solenoid coil 32 and the valve body 36, and the moving part 46 is engaged with the flange 40 of the valve body 38.

While the solenoid coil is not supplied with power, the valve body 38 is pressed in the direction of the fuel injection orifice 37 by the pressing force of the plate spring 44, the contact ridge 41 of the flange is brought into contact with the inside face of the valve box 36, and the fuel injection orifice 37 is closed. Fuel in the box 31 pressurized by the air pressure in the crank chamber 2 remains in the box 31 without injection. An O-ring may be provided to the valve box 36 in stead of the contact ridge 41.

When the solenoid coil is supplied with power, the solenoid coil pulls the valve body 38 toward the magnetic core 34 against the forcing force of the plate spring 44. A clearance is formed between the flange 40 of the valve body 38 and the valve box 36. Fuel pressurized by the air pressure in the crank chamber 2 in the box 31 is injected from the fuel injection orifice to the outside of the box 31.

Fuel injected from the fuel injector 30 is mixed with air taken in depending on the opening of the throttle valve 14, and enters from the air intake valve 17 which opens at the prescribed timing into the cylinder S. The glow plug 19 ignites the fuel-air mixture at the prescribed timing, and the burning starts. The piston P reciprocates in the cylinder S. The reciprocation of the piston P forces the crank shaft K to rotate. The combustion gas is exhausted to the outside of the cylinder from the exhaust valve which opens at the prescribed timing.

In the fuel injector 30 of the embodiment, the pulsatory air pressure having the peak value of positive pressure of about 20 kPa to 100 kPa and the peak value of negative pressure of about −0.5 kPa to −30 kPa is used. These values considerably lower than the fuel pressure of a fuel injector of an actual vehicle of 250 kPa to 300 kPa, that is, these values are ⅓ to 1/13 times that of actual vehicle. Therefore, only the low pressure which the plate spring 44 exerts onto the valve body 38 is sufficient, and the plate spring 44 which can cause only a reduced elastic force (the peak value of positive pressure is 20 kPa to 100 kPa and the peak value of negative pressure is −0.5 kPa to −30 kPa, therefore the elastic force which can endure the pressure fluctuation smaller than 100 kPa) which can endure the same pressure fluctuation as applied to fuel may be used sufficiently to stop the flow of fuel. The displacement is small and the pressure applied to fuel is low, and thus the solenoid coil for moving the valve body 38 and the plate spring 44 may be small sized.

Further, the fuel injector 30 is actuated during suction stroke (in some cases, the fuel injector 30 is actuated just before suction stroke in view of operating time), and this engine 1 is a four-cycle engine, therefore, the pressure in the cylinder is lowered during a suction stroke, on the other hand, the pressure in the crank chamber 2 turns to increase. Because fuel is injected when the pressure in the crank chamber 2 exceeds the pressure in the cylinder, by applying a pressure equivalent to the pressure in the crank chamber 2 to fuel, the fuel is injected efficiently into the cylinder.

The centrifugal force caused by wight and acceleration and deceleration is larger as the density of an object to which a force is exerted is larger. Generally, the density of fuel used for model planes is 800 to 900 kg/m$^3$ and the density of air is 1 to 1.3 kg/m$^3$, the difference between both densities is large. In other words, air is not affected very much by the force due to acceleration in comparison with fuel. The fuel injector 30 of the embodiment utilizes this principle. In detail, fuel is not pressurized with a high pressure but, fuel is introduced into the fuel injector 30 and confined by the check valve 24, fuel is pressurized by air which is not affected by the force due to acceleration, this principle is the feature of the present invention. According to the engine for models 1 having the fuel injector 30 of the embodiment, the supply of fuel is stable even under the severe operational conditions, the engine 1 will not stall due to insufficient fuel and excessive fuel.

The fuel injector 30 of the embodiment is incorporated at the prescribed suitable position of the engine 1 mounted on a prescribed suitable position on a model plane. In detail, the fuel injector 30 should be positioned on the model plane in a certain relationship. That is, the motion direction of the valve body 38 of the fuel injector 30 is parallel to the movement direction of the model plane, and the fuel injection orifice 37 of the fuel injector 30 is directed forward to the movement direction of the model plane.

When the model plane is accelerated rapidly, the rotation speed of the engine 1 is increased rapidly. To increase rapidly, it is required to increase the feed of fuel as fast as possible. In the case of this fuel injector 30, the moving direction of the valve body 38 to open the fuel injection orifice 37 is reverse to the movement direction of the model plane. Therefore, when power is supplied to the solenoid coil 32 to move the valve body 38, an inertia force is exerted to the valve body 38 in the direction reverse to the flying direction of the model plane, and the movement of the model plane itself favors the movement of the valve body 38 in the direction toward the magnetic core 34. Therefore, the fuel injector 30 responses rapidly in opening operation, the valve body 38 can be moved faster to open the fuel injection orifice 37 faster in comparison with the conventional fuel injector, and the feed of fuel is increased rapidly.

To the contrary, when the model plane is decelerated rapidly, the power supply to the solenoid coil 32 is stopped, the valve body 38 is brought into contact with the valve box 36 by the elastic force of the plane spring 44, and the fuel injection orifice 37 is closed. While the model plane is decelerated, the inertia force is exerted to the valve body 38 of the fuel injector 30 in the same direction as the movement direction of the model plane, and thus the movement of the model plane itself favors the movement of the valve body 38 in the direction toward the force of the plane spring 44. Therefore, the fuel injector 30 responses rapidly in closing operation, the valve body 38 can be moved faster to close the fuel injection orifice 37 faster in comparison with the conventional fuel injector, and the feed of fuel is decreased rapidly.

In the embodiment described herein above, a system in which air pressure generated in the crank chamber 2 of the engine 1 is used to pressurize the fuel is employed, however, alternatively instead of this system, a system in which air pressure of the air bomb 9 is used to pressurize the fuel may be employed. For example, a minute hole 2*a* is formed on the wall of the crank chamber 2 as shown in FIG. 2, a check valve which allows air to flow into the crank chamber 2 is provided, the check valve is communicated to the fuel tank 20 not shown in the figure so that air pressure in the crank chamber 2 is applied to the fuel in the fuel tank 20.

According to the fuel injector 30 of the embodiment, because the acceleration caused from the movement of the model plane is utilized to move the valve body 38 of the fuel injector 30, only a small attractive force of the solenoid coil 32 provided to move the valve body 38 is sufficient to move the valve body 38, and thus the solenoid coil can be small sized and operated with small power.

According to the fuel injector 30 of the embodiment, the engine responses quickly to the operation of the models and the engine 1 will not stall due to insufficient fuel and excessive fuel.

Figure 3:
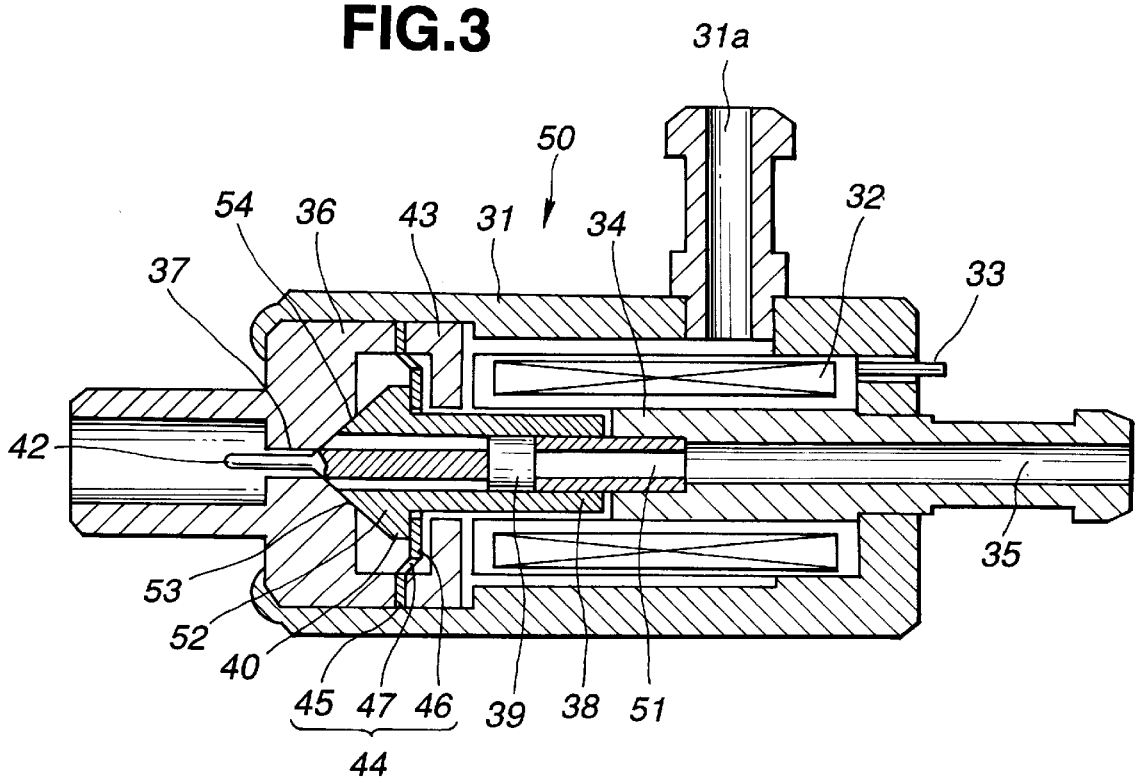
FIG. 3 is a cross sectional view of a fuel injector of the second embodiment of the present invention.

The second embodiment of the present invention is described referring to FIG. 3. The same engine 1 and the same model on which the engine 1 is mounted as used in the first embodiment are used in this embodiment.

Figure 2:
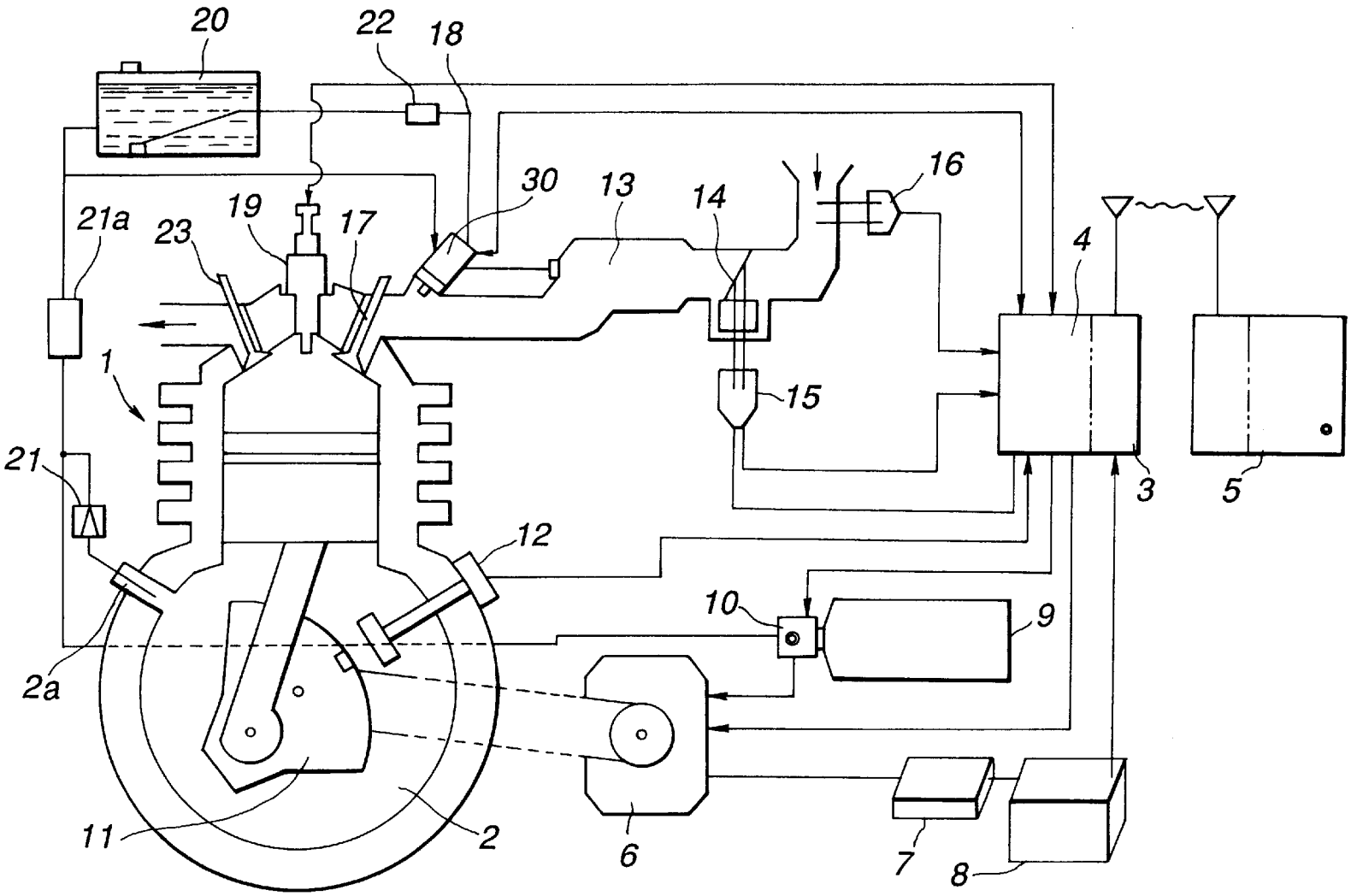
FIG. 2 is a schematic structural view of an engine 1 using the fuel injector of the first embodiment of the present invention.

In the fuel injector 50 shown in FIG. 3, the same functionally equivalent components as those of fuel injector 30 of the first embodiment are given the same characters as used in FIG. 2, and detailed description is omitted.

An air inlet 31*a* is provided on the side peripheral surface of the box 31 for connecting and communicating to the air bomb 9 or the crank chamber 2 in order to introduce air pressure into the box 31. A fuel feeding pipe 18 guided from the fuel tank 20 is connected to a fuel feeding passage 35 formed in the magnetic core 34 of the solenoid coil 32. Pressurized air introduced from the air bomb 9 or the crank chamber 2 of the engine 1 is introduced into the fuel tank 20 like the first embodiment, and fuel is pressurized with a low pressure.

One end of a connecting tube 51 is connected to one end of the magnetic core 34 of the solenoid coil 32. The other end of the connecting tube 51 is inserted slidably to the passage 39 of the valve body 38. The front face of the head 52 of the valve body 38 is formed in a shape of conical surface 53 to serve for sealing, and this sealing surface 53 is similar to the concave conical surface 54 formed on the valve box 36. The passage 39 of the valve body 38 is branched and to opens to the sealing surface 53. The needle 42 is provided on the end of the valve body 38, and inserted into the fuel injection orifice 37 of the valve box 36.

Between the fixing member 43 of the solenoid coil 32 and the valve box 36, the plate spring 44 is provided as a forcing means for forcing the valve body 38 in the direction of the fuel injection orifice 37. The fixing part of the plate spring 44 is fixed between the fixing member of the solenoid coil 32 and the valve box 36, and the moving part of the plate spring 44 is engaged with the head of the flange 40 of the valve body 38.

When power is supplied to the solenoid coil 32, the magnetic core 34 pulls the valve body 38 against the elastic force of the plate spring 44 to form a clearance between the sealing surface 53 and the conical surface 54 of the valve box 36. Pressurized fuel supplied into the box 31 is injected together with pressurized air from the fuel injecting orifice 37 to the outside of the box 31 with the same pressure synchronously with fuel injection timing. When, because the flow of the pressurized air is fast, the air flow acts to suck out the fuel to the outside of the box 31. Therefore in this embodiment, the pressurized fuel supplied into the fuel injector 50 is mixed with pressurized air introduced from the pressure supplying means to the box 31 to a some extent, and then injected from the fuel injecting orifice 37 in a form of mist, thereby the combustion efficiency of the engine 1 is improved.

As described herein above, this fuel injector 50 provides a function like that of a carburetor used for the conventional engines, the action of supercharging is obtained by controlling the feeding of air relatively to the feeding of fuel, and the power of the engine 1 can be boosted up.

The fuel injector 50 of the embodiment is incorporated in the engine 1 mounted on a model plane, therefore fuel can be fed insufficiently due to the effect of centrifugal force and gravity. However, air which has a low specific gravity and is not affected very much by centrifugal force and gravity is fed to the fuel injector 50 with the same pressure as that of fuel. The required quantity of fuel is fed into the fuel injector 50 because of combum effect of air regardless of centrifugal force due to flying movement of the model plane and gravity.

While power is not supplied to the solenoid coil 32, pressurized air guided into the box 31 exerts a force on the flange 40 of the head of the valve body 38 to push the valve body 38 in the direction so as to close the fuel injection orifice 37. Also the plate spring 44 pushes the valve body 38 in the direction so as to close the fuel injection orifice 37. Thereby, the fuel injection orifice 37 is closed consistently while fuel is not injected and fuel will not leak.

Figure 4:
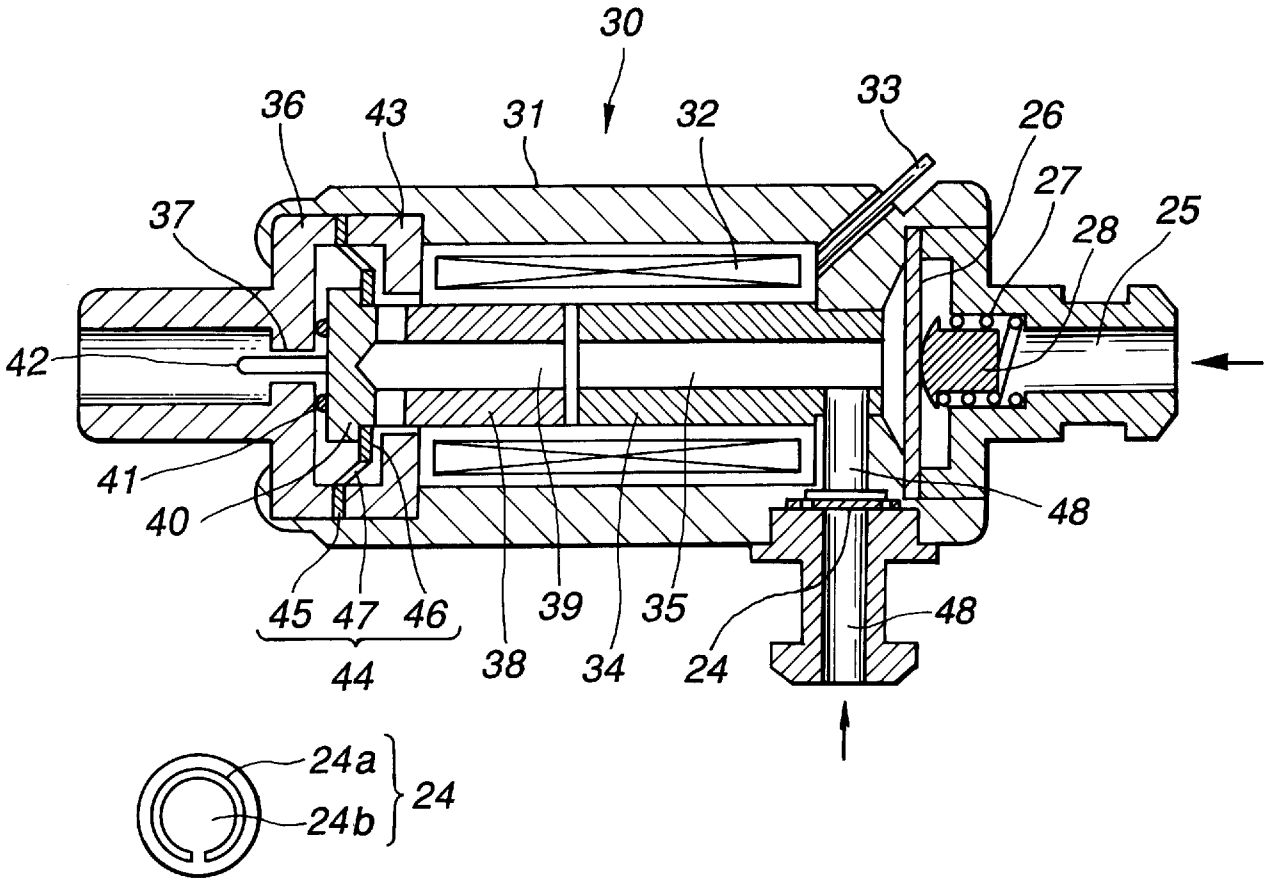
FIG. 4 is a cross-sectional view of a fuel injector of the third embodiment of the present invention.
Figure 5:
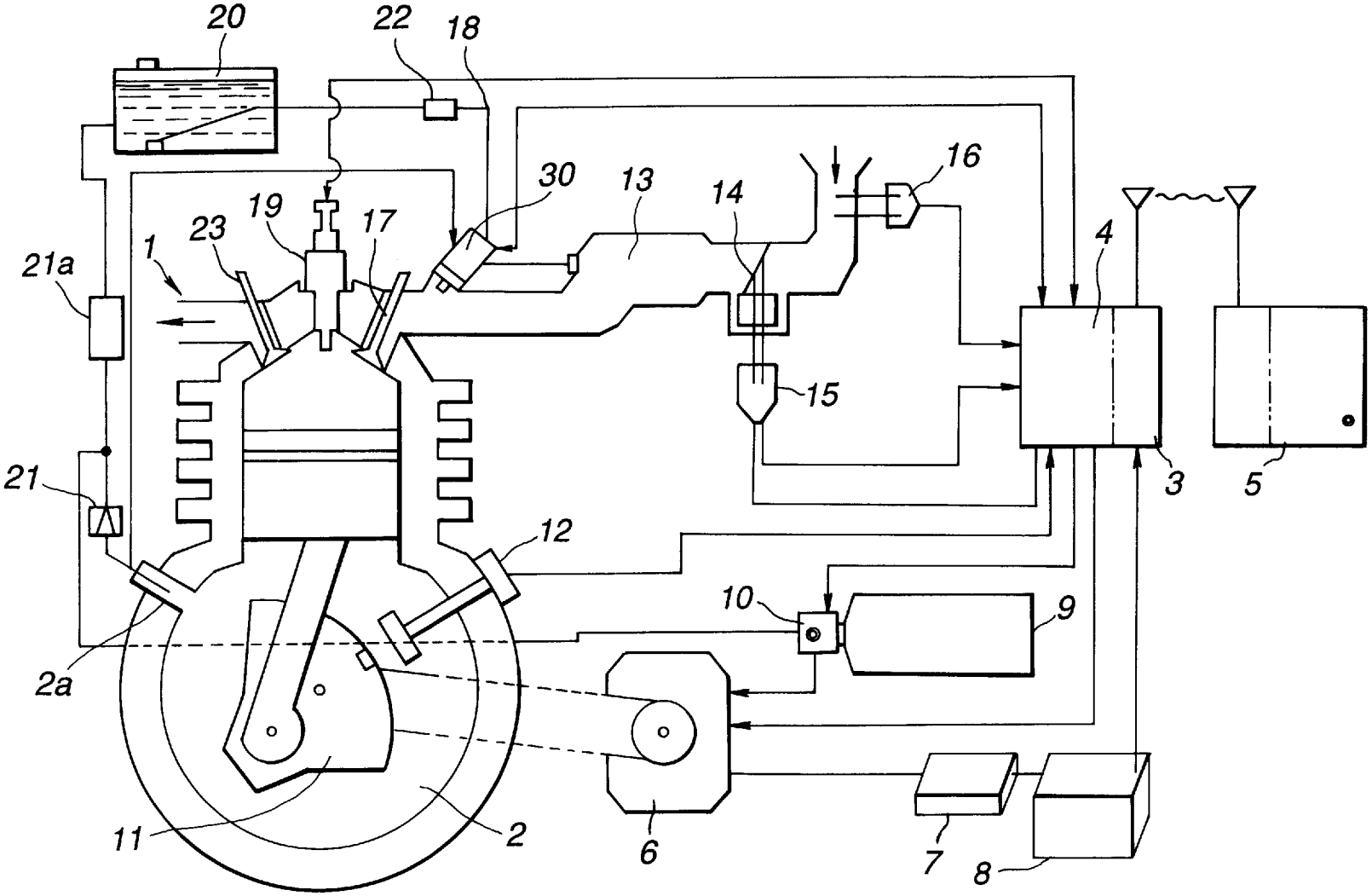
Fig. 5 is a schematic structural view of an engine 1 using the fuel injector of the third embodiment of the present invention.

The third embodiment of the present invention is described referring to FIG. 4 and FIG. 5.

The crank chamber 2 and fuel injector 30 are connected directly, the air pressure generated in the crank chamber 2 caused by driving of the engine is applied to the fuel in the fuel injector 30. In detail, the air pressure in the crank chamber 2 is used as a pressure means for pressurizing the fuel in the fuel injector 30 in the embodiment, and the pulsatory air pressure having the peak value of positive pressure of about 20 kPa to 100 kPa and the peak value of negative pressure of about −0.5 kPa to −30 kPa is used. In the fuel injector 30 of the embodiment, the fuel injector 30 is rendered with pump function utilizing the pulsatory air pressure.

A fuel feeding passage 48 is provided on the side peripheral surface of the magnetic core 34 for communicating to the passage 35. The fuel feeding passage 48 communicates to the outside extending through the box 31. The fuel feeding passage 48 is connected to the fuel feeding pipe conduit 18 guided from the fuel tank 20.

In the fuel feeding passage 48, a check valve 24 is provided as a reverse flow preventing means for preventing reverse flow of fuel fed into the box 31. As shown in FIG. 4, the check valve 24 is a plate like approximately circular member having a prescribed elasticity, and on the central portion of the check valve 24, a circular hole 24*a* and an approximately circular valve member 24*b* for controlling the opening of the hole 24*a* which valve member 24*b* is continuous partially to the edge of the hole 24*a* are formed. The inside diameter of the fuel feeding passage 48 provided outside the check valve 24 and in contact with the check valve 24 is narrower than the outside diameter of the valve 24*b* of the check valve 24, and a space having an inside diameter wider than the outside diameter of the valve member 24*b* of the check valve 24 is formed in the fuel feeding passage 48 provided outside the check valve 24. Therefore, the valve member 24*b* of the check valve 24 can not open to the outside, and fuel in the box 31 will not flow to the outside of the box 31. To the contrary, the valve member 24*b* of the check valve 24 provided at the gap portion can open to the inside of the box 31, and thus the fuel fed from the external can be introduced into the box 31 smoothly.

An air pressure supply passage 25 is formed on the base end of the box 31 for applying air pressure to fuel in the box 31. The outside end of the air pressure supply passage 25 is connected to the crank chamber 2 (alternatively, connected to the air bomb 9 which is the air pressure supply means) as described hereinbefore. A diaphragm 26 which is made of flexible material is provided in the internal of the air pressure supply passage 25 to apply the air pressure supplied from the crank chamber 2 of the engine to the fuel in the box 31. The diaphragm 26 of the embodiment is consists of, for example, silicone rubber film. The diaphragm 26 defines air-tightly between the space in the box 31 containing fuel and the air pressure supply passage 25. A pressure member 28 is provided with interposition of a spring 27 on the side of air pressure supply passage 25 of the diaphragm 26. The pressure member 28 is in contact with the diaphragm 26 with a prescribed force caused by the spring 27. The end of the pressure member 28 is rounded, and is in contact with the diaphragm 26 over a wide area and can apply stably a prescribed pressure on the diaphragm 26. The air pressure from the crank chamber actuates the pressure member 28 to press the diaphragm 26. The diaphragm 26 is deflected toward the inside of the box 31, and applies a pressure to the fuel in the box 31.

The operation of the fuel injector of the embodiment is described. When fuel is injected, a voltage is applied to the solenoid coil 32 to cause a magnetic force in the magnetic core 34. The magnetic core 34 pulls the valve body 38 against the pressing force of the plate spring 44. When, the air pressure in the crank chamber 2 of the engine 1 increases with lowering of the piston. The air pressure is applied to the fuel in the fuel injector 30 through the diaphragm 26 of the fuel injector 30, simultaneously the fuel feeding passage 48 of the fuel injector 30 is closed by the check valve 24. The fuel in the fuel injector 30 pressurized with the air pressure applied through the diaphragm 26 is injected from the fuel injection orifice 37 to the outside of the box 31. The fuel injection timing is determined by a rotation sensor 12 for detecting the position of the crank 11.

A radio control model plane on which an engine for models is mounted having the fuel injector 30 of the embodiment performs often acrobatic flying such as loop flying which an actual plane seldom performs. Under such severe flying condition, the feeding of fuel to a fuel injector is apt to be unstable. In detail, fuel in a fuel tank and fuel in a fuel feeding pipe conduit which connects between a fuel tank and the fuel injector is affected by gravity and centrifugal force due to exquisite operations of the model plane, and the magnitude and direction change rapidly. The pressure applied to fuel fed to the fuel injector can not be maintained constant, and in the engine mounted on the model plane, fuel can be affected by the centrifugal force and gravity to result in unstable feeding of fuel.

However, according to the fuel injector 30 of the embodiment, because the fuel filled once in the fuel injector 30 is confined by the check valve 24, the fuel will not flow reversely from the fuel injector 30 regardless of changing of the pressure applied to the fuel fed to the fuel injector 30 due to the above-mentioned external cause. Further, the change of the air pressure generated in the crank chamber 2 can be applied to the fuel through the diaphragm 26.

In detail, if the air pressure generated in the crank chamber 2 is higher than the pressure applied to the fuel, then the diaphragm moves to the side of the valve body 38, and the fuel in the fuel injector 30 is pressurized. On the contrary, the air pressure generated in the crank chamber 2 is lower than the pressure applied to the fuel, then the diaphragm 26 moves to the side of the air pressure supply passage 25, and the check valve 24 is opened and the pressure applied to the fuel in the fuel injector 30 becomes approximately equal to the pressure of the fuel in the fuel feeding passage 48.

Figure 6:
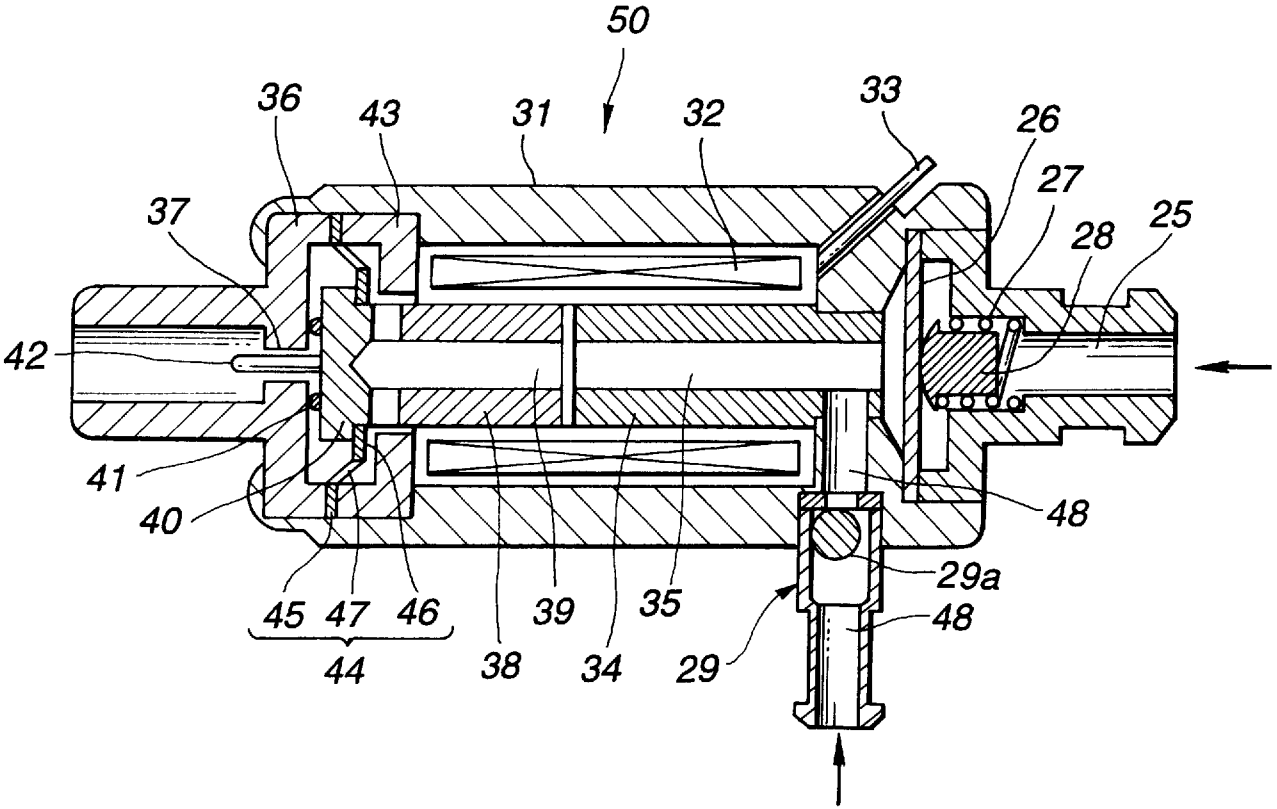
FIG. 6 is a cross-sectional view of a fuel injector of the fourth embodiment of the present invention.

The fourth embodiment of the present invention is described referring to FIG. 6. The engine 1 to which the fuel injector 50 of this embodiment and the model to which the engine 1 is mounted are the same as those described in the third embodiment. In the fuel injector 50 shown in FIG. 6, the same functionally equivalent components as those of fuel injector 30 of the third embodiment are given the same characters as used in FIG. 5, and detailed description is omitted. The check valve of this fuel injector 50 is different from that of the third embodiment in the structure. This check valve 29 has a plastic ball made of plastic as the valve body 29*a*. This check valve 29 has the same function as that of the third embodiment.

Figure 7:
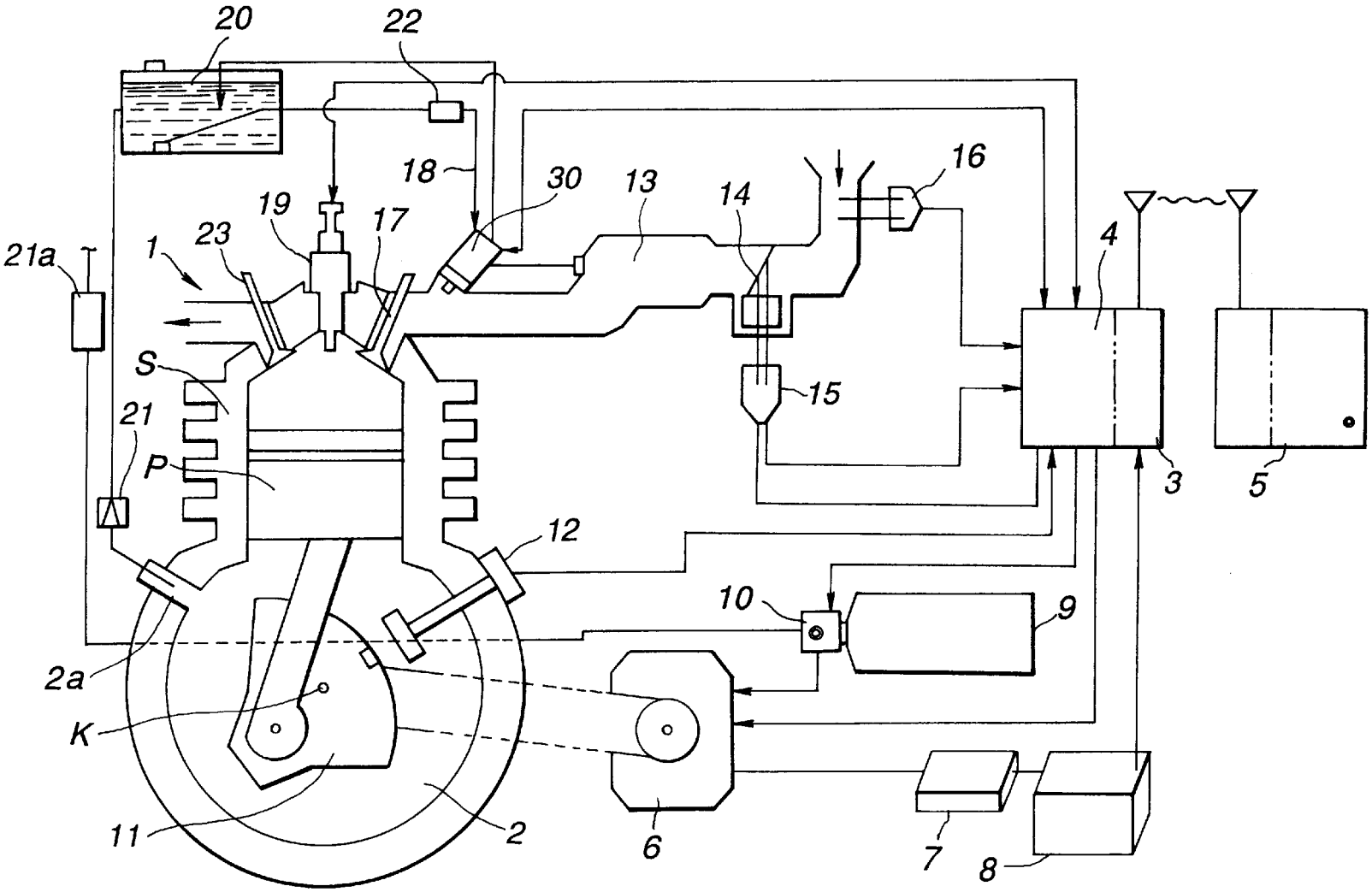
FIG. 7 is a schematic structural view of the fifth embodiment of the present invention.
Figure 8:
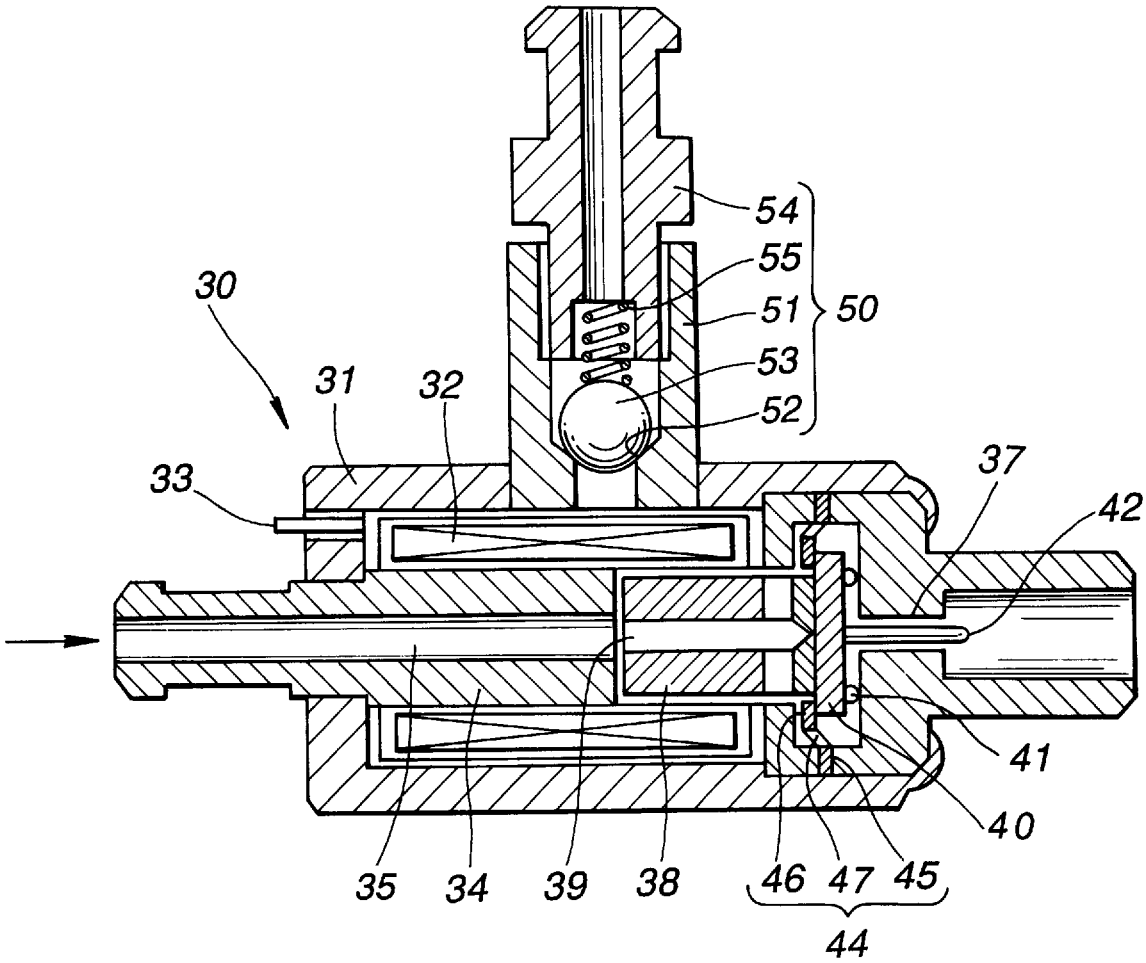
FIG. 8 is a cross-sectional view of the fuel injector of the fifth embodiment of the invention.

The fifth embodiment of the present invention is described referring to FIG. 7 and FIG. 8.

An over pressure control valve 50 is provided on the side peripheral surface of the box 31 as a pressure adjusting means for adjusting the pressure applied to the fuel in the box 31. The cylindrical base 51 is connected to the box 31, and communicated to the internal. The tapered seat surface 52 is formed on the inside end of the base 51 which is the end near the box 31. The balance ball 53 which is the valve body is provided in the base 51. On the inside of the outer end of the base 51, a cylindrical adjusting nozzle 54 is screwed. A spring 55 which serves as a forcing means is provided in the step portion of the adjusting nozzle 54. The spring 55 exerts a force to press the balance ball 53 against the seat surface 52 and to bring the balance ball 53 in close contact with the seat surface, and the base 51 is closed. By turning the adjusting nozzle 54, the adjusting nozzle 54 can be moved from the base 51, and the pressing force exerted to the balance ball by the spring 55 can be adjusted. The adjusting nozzle 54 is connected to the fuel tank 20 through the return tube 56 as shown in FIG. 7.

The over pressure control valve 50 having the structure described herein above will be dead while the pressure of the fuel in the box 31 remains at a prescribed value. When the pressure of the fuel in the box 31 increases, the fuel pressure defeats the pressing force of the spring 55, and the balance ball 53 moves toward outside and departs from the seat surface 42. Fuel is released to the outside of the box 31, the pressure of fuel is maintained at a prescribed pressure. The released fuel is returned to the fuel tank 20 through the return tube 56. The pressure of fuel at which the over pressure control valve 50 is activated and fuel is released to the outside is prescribed arbitrarily by adjusting the adjusting nozzle 54.

When a model plane on which an engine 1 is mounted performs exquisite movement such as rapid acceleration, rapid deceleration, and loop flying, severe acceleration is exerted to the fuel in the fuel tank 20 and the fuel feeding passage to cause severe change of the pressure of fuel fed to the fuel injector 30. Because the fuel injector 30 controls the fuel injection quantity by controlling open time, the increase of the fuel pressure in the fuel injector 30 due to such severe operational conditions exceeding a prescribed value causes the deviation of fuel injection quantity from a prescribed quantity, and thus the stable engine rotation can not be maintained.

However, according to the fuel injector 30 of the embodiment, when the pressure of the fuel in the box 31 increases beyond a prescribed value, the over pressure control valve 50 is activated to release fuel to the outside, the fuel is released to the outside of the box 31. When the pressure of the fuel in the box 31 resumes to the prescribed value, then the over pressure control valve 50 closes again. Thereby, the fuel pressure in the box 31 is maintained at a prescribed constant value. The injection pressure of fuel remains constant regardless of abnormal increase of the feeding fuel pressure, the fuel injection is controlled adequately. The balance of air-fuel ratio is maintained and the engine rotates stably.

In this embodiment, the fuel injection starting timing is determined based on the intake timing signal supplied from the rotation sensor 12, and the fuel injection time is determined based on the throttle adjusting signal supplied to the throttle valve driving means 15 to drive the throttle valve 14. The fuel injection signal for driving the fuel injector 30 is generated from the determined fuel injection starting timing and the fuel injection time. The control means 4 corrects the fuel injection time depending on the temperature in the combustion chamber detected by the temperature sensor provided to the glow plug 19. The control means 4 corrects also the fuel injection time depending on the rate of change of the throttle adjusting signal when the rate of change of the throttle adjusting signal exceeds a reference value. The correction function and the function of the over pressure control valve 50 to maintain the fuel pressure constant ensure synergistically the function to inject stably the adequate quantity of fuel at the adequate timing and the speed of response is improved.

Figure 9:
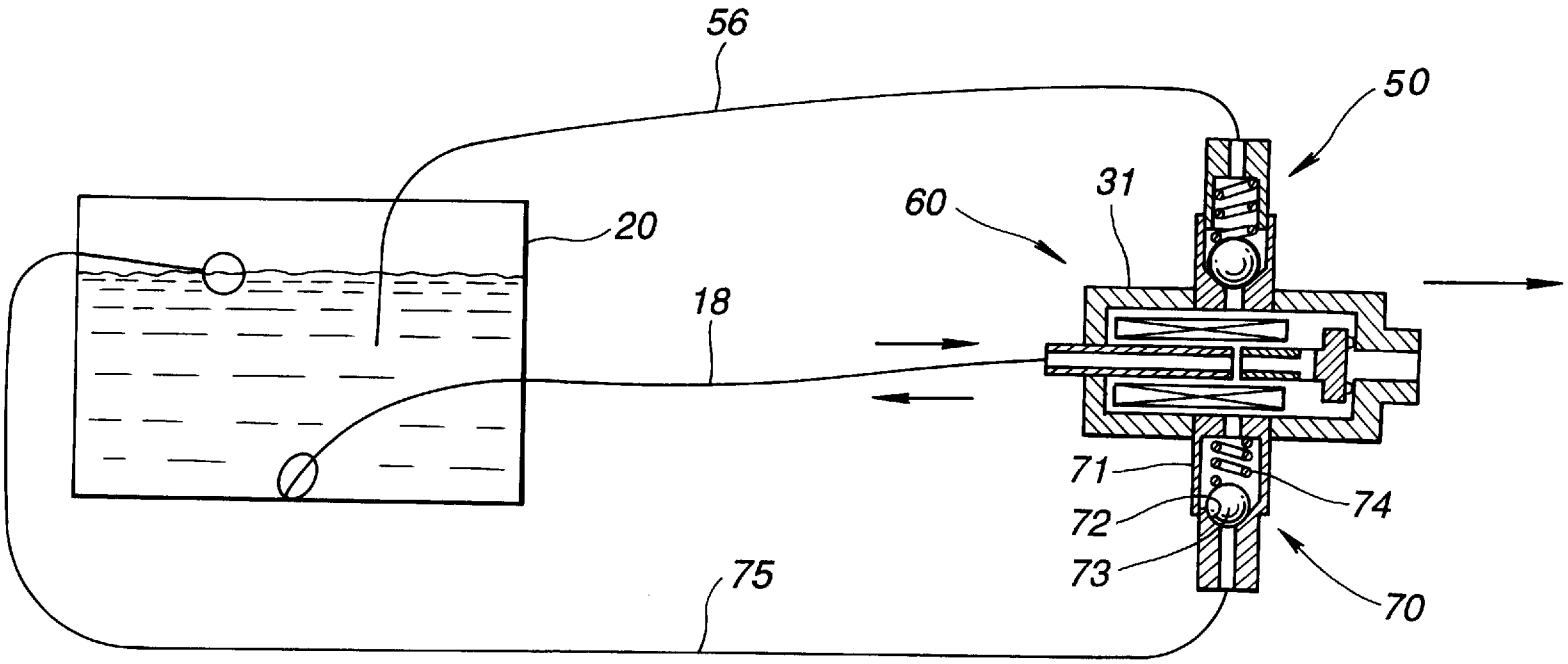
FIG. 9 is a schematic structural view mainly of a fuel injector of sixth embodiment of the present invention.
Figure 10:
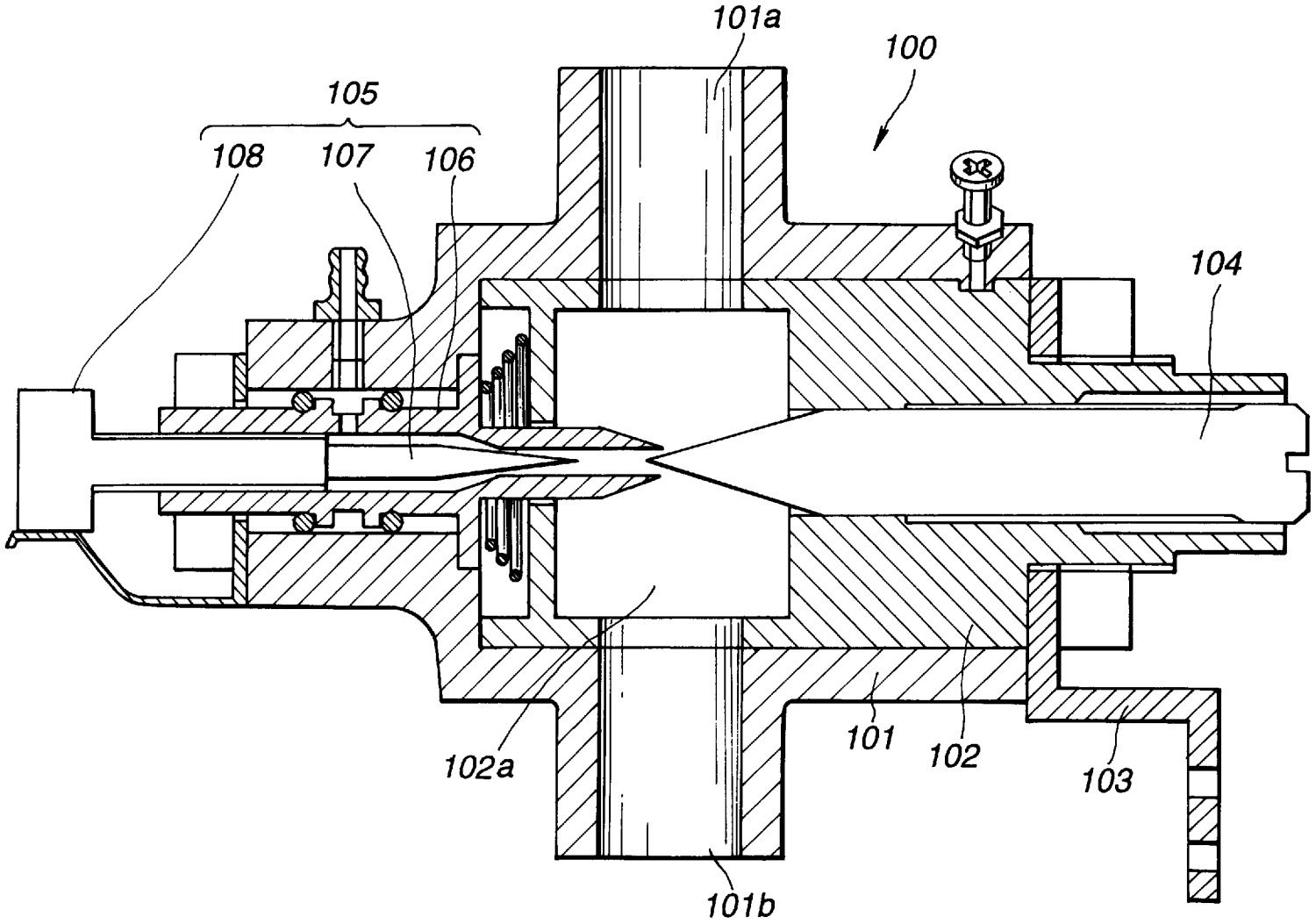
FIG. 10 is a cross-sectional view of a conventional throttle valve.

The sixth embodiment of the present invention is described referring to FIG. 9. The same engine 1 to which the fuel injector 60 of the embodiment is applied, the same model on which the engine 1 is mounted, and the same receiver 3 and control means 4 for controlling the engine 1 as used in the fifth embodiment are used in this embodiment. This fuel injector 60 is provided with a negative pressure control valve 70 as the pressure adjusting means in addition to the over pressure control valve 50. The structure of this embodiment is same as the structure of the fuel injector 30 in the fifth embodiment excepting the components described herein above. Components corresponding to the fifth embodiment are given the same characters as shown in FIG. 7 and FIG. 8, and detailed description is omitted.

The negative pressure control valve 70 is provided on the side peripheral surface of the box 31. The cylindrical base 71 is connected to the box 31 and communicated to the internal. A tapered seat surface 72 is formed on the outside of the base 71 and accommodates a balance ball 73 which is a valve body in the inside. A spring 74 which is a forcing means is provided on the box 31 side of the base 71. The spring 74 exerts a force to press the balance ball 73 against the seat surface 72, and to bring the balance ball 53 in close contact with the seat surface, and the base 51 is closed. The pressing force of the spring 74 exerted to the balance ball 73 may be structured so as to be controlled by structuring the structure like the over pressure control valve 50. The outer end of the base 71 is connected to the fuel tank through the air pressure supply tube 75 as shown in FIG. 9. A float which is floating on the fuel is provided on the end of the air pressure supply tube 75 in the internal of the fuel tank 20. Fuel will not flow into the air pressure supply tube 75. The air pressure in the crank chamber 2 supplied into the fuel tank 20 is supplied to the air pressure supply tube 75, and the air pressure is applied to the negative pressure control valve 70 from the outside.

As shown in FIG. 9, the fuel injection direction of this fuel injector 60 is directed forward in the movement direction of the model plane. The fuel injector 60 is located ahead of the fuel tank 20 in the movement direction of the model plane.

When, for example, the model plane is decelerated rapidly during flying in the arrow direction as shown in FIG. 9, fuel in the fuel feeding pipe conduit 18 is fed excessively to the fuel injector 60 due to inertia, and the fuel pressure in the fuel injector 60 increases. Like the fifth embodiment, the over control valve 50, which has been closed because of the pressure balance between the outside and inside pressure, is opened, and fuel in the fuel injector 60 returns to the fuel tank 20 through the return tube 56 until the balance between the outside and inside pressure resumes. Thereby, the fuel pressure in the fuel injector 60 is maintained at a constant value, and fuel is injected stably at a constant pressure.

When, for example, the model plane is accelerated rapidly during flying in the arrow direction as shown in FIG. 9, fuel in the fuel feeding pipe conduit 18 is fed insufficiently to the fuel injector 60 due to inertia, and the fuel pressure in the fuel injector 60 decreases. The negative pressure control valve 70, which has been closed because of the pressure balance between the outside and inside pressure, is opened, and air with the same pressure as applied to the fuel in the fuel tank 20 is supplied into the fuel injector 60 through the air pressure supply tube 75 until the balance between the outside and inside pressure resumes. Thereby, the fuel pressure in the fuel injector 60 is maintained at a constant value, and fuel is injected stably at a constant pressure.

The negative pressure control valve 70 of the fuel injector 60 of the embodiment is a valve which utilizes this principle and the pressurization of the fuel in the fuel injector 60 using air which is not affected very much by the force due to acceleration features this fuel injector 60. The use of the engine 1 incorporated with the fuel injector 60 of the embodiment leads to the stable fuel feeding even under severe operational conditions, and the engine 1 will not stall due to insufficient fuel and excessive fuel.

In respective embodiments, the fuel injector is used for an engine mounted on a radio control model plane only for description, however, the model in the present invention includes not only radio control model planes for hobby but also moving articles having an engine used for generally industrial use, and includes model vehicles and model boats.

The fuel injector of the present invention is applied not only to four-cycle engines but also to two-cycle engines and other various types of engines.

In the case that the fuel injector of the present invention is applied to a two-cycle engine, because a suction stroke and compression stroke are operated simultaneously in a two-cycle engine, fuel is injected into the crank chamber during a compression stroke (in some cases fuel is injected during an exhausting/scavenging stroke in view of delayed operation of the fuel injector). When, the pressure in the crank chamber decreases and also the pressure applied to fuel decreases if the pressure in the crank chamber is used directly, however, if the pressure in the crank chamber is supplied to fuel with interposition of a check valve or regulator in order to apply the pressure in the crank chamber of only the positive range (from 0 to the maximum) to fuel, or if the pressure in the air bomb is applied to fuel, then the pressure applied to fuel is higher than the pressure in the crank chamber, and thus fuel is supplied efficiently. If the pressure source such as air bomb is used, the pressure my be somewhat higher than the maximum pressure of the positive pressure generated in the crank chamber.

The absolute value of the positive pressure and negative pressure generated in the crank chamber is almost equal in the case of a four-cycle engine, but is different in the case of a two-cycle engine. In the case of a two-cycle engine, because air flows into the crank chamber during a compression stroke, the absolute value of the negative pressure peak value generated during a compression stroke is lower than the absolute value of the positive pressure generated in the crank chamber during an expansion stroke.

According to the fuel injector for engines in accordance with the present invention, because fuel is injected into the combustion chamber of an engine with a pressure equivalent to the pressure generated in the crank chamber of the engine with aid of electronic control, fuel is fed stably and the air-fuel balance is maintained, and speedy response is attained even if the engine for models is used under severe operational conditions.

According to the fuel injector of engines in accordance with the present invention, because fuel is confined in the internal by a reverse flow preventing means and fuel is injected with a pressure equivalent to the pressure generated in the crank chamber of the engine, fuel is fed stably and the air-fuel balance is maintained, and the engine can exhibit stable and high performance.

According to the fuel injector of engines for models in accordance with the present invention, even if the fuel injector is used for an engine mounted on a radio control model plane which is operated under severe operational conditions such as acrobatic rapid acceleration, rapid deceleration, and loop flying, because the fuel injector has a pressure adjusting means for compensating the feeding fuel pressure change, fuel is injected with a constant pressure stably, thus the air-fuel balance is maintained, and the engine exhibits stable and high performance.

While a preferred embodiment of the present invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A fuel injector in a model engine having a combustion chamber, a crank chamber, a source of fuel pressurized to a pressure in the crank chamber, and an electronic controller, the fuel injector comprising:

a port receiving the pressurized fuel; and a solenoid operated valve controlled by said electronic controller to discharge the pressurized fuel into the combustion chamber.

2. The fuel injector as claimed in claim 1, wherein said fuel injector comprises a box and a fuel injection orifice, wherein said valve comprises a solenoid coil provided in said box, a magnetic core provided in said solenoid coil, a valve body provided in said box and movable in an axial direction of said solenoid coil to said magnetic core by supplying power to said solenoid coil to open said fuel injection orifice, and an element exerting a force to press said valve body in the direction so as to close said fuel injection orifice.

3. The fuel injector as claimed in claim 2, wherein a maximum pressure generated in the crank chamber of said engine for models is in a range from 20 kPa to 100 kPa.

4. The fuel injector as claimed in claim 3, wherein the pressing force of said element exerting a force is equivalent to the force exerted to said valve body by said fuel.

5. The fuel injector as claimed in claim 2, wherein the axial direction of said solenoid coil is disposed in parallel to a movement direction of the model on which said engine for models is mounted, and the fuel injection orifice of said solenoid coil is directed forward in the movement direction of said model.

6. A fuel injector in an engine for models, provided with a reverse flow preventing means for preventing fed fuel from reversing and a pressuring means for pressurizing the fed fuel with a pressure equivalent to a pressure generated in a crank chamber of the engine for models, for injecting pressurized fuel into a combustion chamber of the engine for models with aid of electronic control.

7. The fuel injector as claimed in claim 6, wherein said reverse flow preventing means is a check valve, and said pressurizing means is a flexible member for transmitting air pressure generated in the crank chamber of the engine for models to the fed fuel.

8. The fuel injector as claimed in claim 6 or 7, wherein the engine has a piston and the pressure generated in a crank chamber of said engine for models is pulsatory synchronously with motion of the piston.

9. A fuel injector in an engine for models provided with a box, a fuel feeding passage for guiding fuel into said box, a fuel injection orifice provided to said box, a solenoid coil provided in said box, a magnetic core provided in said solenoid coil, a valve body provided in said box and movable in an axial direction of said solenoid coil to said magnetic core magnetically by supplying power to said solenoid coil to open said fuel injection orifice, and biasing means for exerting a force to press said valve body in the direction so as to close said fuel injection orifice. a check valve for preventing the fuel guided into said box from reversing into said fuel feeding passage, an air pressure supply passage for supplying air pressure generated in a crank chamber of the engine for models into said box, and a flexible member for applying the air pressure supplied through said air pressure supply passage to fuel in said box.

10. A fuel injector of an engine for models into which fuel pressurized with a prescribed pressure is fed and injected therefrom by moving a valve body for controlling an opening of a fuel injection orifice, wherein said fuel injector includes a pressure adjusting means for adjusting a fuel pressure so that the fuel pressure maintains said prescribed value when the pressure of the fed fuel fluctuates.

11. The fuel injector as claimed in claim 10, wherein said pressure adjusting means is an over pressure control valve for releasing fuel to outside of the fuel injector when the pressure of the fed fuel increases.

12. The fuel injector of an engine for models as claimed in claim 11, further including a negative pressure control valve as said pressure adjusting means.

13. The fuel injector as claimed in claim 10, 11, or 12, wherein said engine is provided on a moving article on which a fuel tank is mounted, an injection direction of said fuel injector is directed forward in a movement direction of said moving article, and said fuel injector is located ahead of the fuel tank in the movement direction of said moving article.

14. An engine for models, the engine having a combustion chamber, a crank chamber, an electronic controller and a fuel injector, wherein said fuel injector injects pressurized fuel with a pressure equivalent to a pressure generated in the crank chamber into the combustion chamber.

* * * * *